US007854243B2

(12) United States Patent
Liao et al.

(10) Patent No.: US 7,854,243 B2
(45) **Date of Patent: *Dec. 21, 2010**

(54) INFLATABLE PNEUMATIC BAG AND THE MANUFACTURE METHOD THEREOF

(75) Inventors: Chian Hua Liao, 18th Fl., No. 227, Sec. 3, Chongxing Rd., Sindan (TW); Bo Xin Jian, Sindan (TW)

(73) Assignee: Chian Hua Liao, Sindian (TW)

( * ) Notice: Subject to any disclaimer, the term of this patent is extended or adjusted under 35 U.S.C. 154(b) by 0 days.

This patent is subject to a terminal disclaimer.

(21) Appl. No.: 12/491,481

(22) Filed: Jun. 25, 2009

(65) Prior Publication Data

US 2009/0297068 A1 Dec. 3, 2009

Related U.S. Application Data

(63) Continuation of application No. 11/430,949, filed on May 10, 2006, now Pat. No. 7,568,508.

(51) Int. Cl.
*B65B 3/16* (2006.01)
*B65B 43/26* (2006.01)
*A63B 39/00* (2006.01)

(52) U.S. Cl. ..... 141/114; 141/10; 141/67; 141/237; 53/385.1; 53/570; 156/147; 156/292

(58) Field of Classification Search ..... 141/1, 141/10, 67, 68, 70, 98, 114, 237; 53/385.1, 53/570; 156/145, 147, 292, 494, 497, 498; 206/522; 428/34.1; 383/44
See application file for complete search history.

(56) References Cited

U.S. PATENT DOCUMENTS

| | | | |
|---|---|---|---|
| 3,207,420 | A | 9/1965 | Navarrete |
| 4,850,912 | A | 7/1989 | Koyanagi et al. |
| 5,261,466 | A | 11/1993 | Koyanagi |
| 5,351,828 | A | 10/1994 | Becker et al. |
| 5,427,830 | A | 6/1995 | Pharo |
| 5,469,966 | A | 11/1995 | Boyer |
| 6,213,167 | B1 | 4/2001 | Greenland |
| 6,827,099 | B2 | 12/2004 | Tanaka et al. |
| 6,955,846 | B2 | 10/2005 | Lerner |

(Continued)

FOREIGN PATENT DOCUMENTS

| | | |
|---|---|---|
| DE | 202004006032 | 9/2004 |

(Continued)

*Primary Examiner*—Timothy L Maust
(74) *Attorney, Agent, or Firm*—Rabin & Berdo, P.C.

(57) ABSTRACT

An inflatable pneumatic bag is disclosed. An inflatable pneumatic bag includes a pneumatic hole disposed at one end of a pneumatic channel. Air, which is applied to the pneumatic hole, moves along the pneumatic channel, then through air ingress holes covered with inner layers which are removed by the expansion of the outer layers to fill all the air tubes. When the air tube is filled with air, one or more inner layers cover and then close the air ingress hole to overcome reverse air flow. Then, a curve-shaped air passage in the air tube narrows to further prevent air escape. With the inner layer, effectively overcoming reverse air flow, and the air passage, further preventing air escape, the inflatable pneumatic bag filled with air may last for a substantial long period of time.

20 Claims, 6 Drawing Sheets

U.S. PATENT DOCUMENTS

| | | | | |
|---|---|---|---|---|
| 7,568,508 | B2 * | 8/2009 | Liao et al. | 141/114 |
| 7,694,820 | B2 * | 4/2010 | Liao et al. | 206/522 |
| 7,695,786 | B2 * | 4/2010 | Liao et al. | 428/34.1 |
| 2005/0109411 | A1 | 5/2005 | Koyanagi | |

FOREIGN PATENT DOCUMENTS

| | | | |
|---|---|---|---|
| JP | 01-045277 | A | 2/1989 |
| JP | 01-199857 | A | 8/1989 |
| JP | 05-095851 | | 12/1993 |
| JP | 06-067370 | U | 9/1994 |
| JP | 08-034478 | | 2/1996 |
| JP | 08-282736 | A | 10/1996 |
| JP | 09-042500 | A | 2/1997 |
| JP | 09-086566 | A | 3/1997 |
| JP | 2000-079951 | A | 3/2000 |
| JP | 2001-039474 | A | 2/2001 |
| JP | 2002-037341 | A | 2/2002 |
| JP | 2002-234577 | A | 8/2002 |
| JP | 2004-306407 | A | 11/2004 |
| JP | 17-162268 | | 6/2005 |
| KR | 0390052 | | 7/2005 |
| WO | WO-90/09320 | | 8/1990 |

* cited by examiner

INFLATABLE PNEUMATIC BAG AND THE MANUFACTURE METHOD THEREOF

CROSS-REFERENCES TO RELATED APPLICATION

The present application is a continuation application of U.S. patent application Ser. No. 11/430,949, filed on May 10, 2006, which is hereby incorporated by reference.

BACKGROUND OF THE INVENTION

1. Field of Invention

The present invention relates to an inflatable bag, more particularly to an inflatable pneumatic bag that may continuously fill all the air tubes at one time and effectively prevent air escape.

2. Description of Related Art

Conventional inflatable bags are heat-sealed to form one or more air tubes which include air ingress holes to fill the air tubes for the use as buffering wrapping material.

U.S. patent application (Publication No. 2005/0109411A1) discloses a plurality of separate, independent air tubes. Each of the air tubes includes an air ingress hole for filling air. The air tube includes two inner layers connecting to the outer layers. When the air tube is filled with air, the two inner layers cover the air ingress hole to prevent the reverse air flow. Because each of the air tubes is separate from each other, filling each of the air tubes separately one at a time is required.

U.S. Pat. No. 5,427,830 discloses a plurality of air tubes which includes one or more air ingress holes for filling the air tubes. Each of the air tubes connects to each other consecutively to form a strip of air tubes so that the air ingress hole may transfer air to fill all the air tubes continuously. However, when one of the air tubes leaks, the rest of the air tubes also run out of air since all the air tubes are connected through a shared passage.

Both of the above patents merely disclose the prevention for reverse air flow when the air tubes are filled with air. However, these air tubes inevitably leak after a substantial long period of time. Therefore, these air tubes may not fill all the air tubes at one time or effectively prevent air tubes from leaking.

SUMMARY OF THE INVENTION

An objective of the invention is to provide an inflatable pneumatic bag having a pneumatic hole disposed at one end of the pneumatic passage that may continuously fill all the air tubes.

Another objective of the invention is to provide an inflatable pneumatic bag that may effectively overcome reverse air flow and further prevent air escape.

Another objective of the invention is to provide an inflatable pneumatic bag that may fill all the air tubes at one time and therefore save the filling time effectively.

To achieve the above objectives, in one aspect, the invention provides an inflatable pneumatic bag with two inner layers and a wall-attached air passage configuration. Two outer layers are provided, one overlying the other. Two inner layers are between the two outer layers. On one plane of the inner layers not facing the outer layers is coated with multiple heat-resistant materials on the regions along the plane. The regions are arranged in a row and separate from each other. During a heat sealing operation, the heat seal lines of the outer layers are sealed to form a pneumatic passage, multiple air ingress holes, and multiple air tubes. The air ingress holes are between the pneumatic passage and the air tubes, which provide a connection allowing air flow between them. The two inner layers are connected to the outer layers with two traverse seals which are formed by heat sealing operation. And the air ingress holes are formed in the regions of the plane of the inner layer covering with heat-resistant materials which may prevent miscibility during the heat sealing operation.

A pneumatic hole in which air is applied to transfers air along the pneumatic passage, then through the air ingress holes to fill all the air tubes. When the air tube is filled with air, the inner layers, which are pressed by the air inside the air tube, cover and then close the air ingress hole. Therefore the reverse air flow is overcome. Further, inside the air tube, there is a curve-shaped air passage having one end connected to the air ingress hole, which its diameter one end is larger than the other end. Also, the air passage contains larger pressure than the pressure inside the air tube. So when the air tube is filled with air, the curve-shaped air passage narrows as the pressure inside the air tube increases, this prevents the air escape.

In this aspect, the pneumatic hole may be disposed at either end of the pneumatic passage. The air passage may connect one end to the air ingress hole and leave the other end suspending in the air tube. The heat-resistant materials may be a heat-resistant gel or a heat-resistant ink. The heat sealing operation is operated by heat press device.

In one embodiment, an inflatable pneumatic bag includes a pneumatic hole disposed on the top of the pneumatic bag strip. Air, which is applied to the pneumatic hole, moves into an air chamber. The air chamber then distributes air through multiple pneumatic passages to fill all the air tubes. When the air tube is filled with air, the inner layers cover, and then close the air ingress hole to overcome reverse air flow. The curve-shaped air passage narrows to further prevent air escape. In this embodiment, the pneumatic hole may be disposed on either side of the air chamber. The air passage may be attached to either of the outer layers.

In one embodiment, an inflatable pneumatic bag includes a pneumatic hole for transferring air along a pneumatic passage. The inflatable pneumatic bag provides multiple air ingress holes and air passages for a single air tube. Air, which is applied to the pneumatic hole, moves along the pneumatic passage and then through the air ingress holes and the air passages to fill all the air tubes. The pneumatic hole may be disposed at either end of the pneumatic passage. When the air tube is filled with air, the inner layers, pressed by air within the air tube cover, and then close the air ingress holes. Therefore the reverse air flow is overcome. The curve-shaped air passage narrows as the pressure in the air tube increase so that the air tube's air escape is prevented. Since each air tube provides more than one air ingress holes and air passages, the filling of all the air tubes becomes substantially efficient and effectively time-saving.

Among the advantages of the invention are the following. The invention provides a pneumatic hole at either end of the pneumatic passage to continuously fill all the air tubes. Either of inner layer settings (single or two inner layers) may overcome reverse air flow, as well as the air passage (wall-attached or suspension type) further prevents air escape. Each of the air tubes is separate. Even under certain circumstance, one or more of the air tubes might leak, the remainder still functions. The air chamber and multiple pneumatic passages arrangement that enables air distributing to all multiple pneumatic passages at one time saves the filling time effectively. By providing more air ingress holes and air passages to a single air tube; filling air into the air tube becomes substantially efficient. The inflatable pneumatic bag of the invention may use to wrap variety of products in an attempt to avoid damages that inevitably occur during the shipment or other circumstances.

DESCRIPTION OF PREFERRED EMBODIMENT

Figure 1:
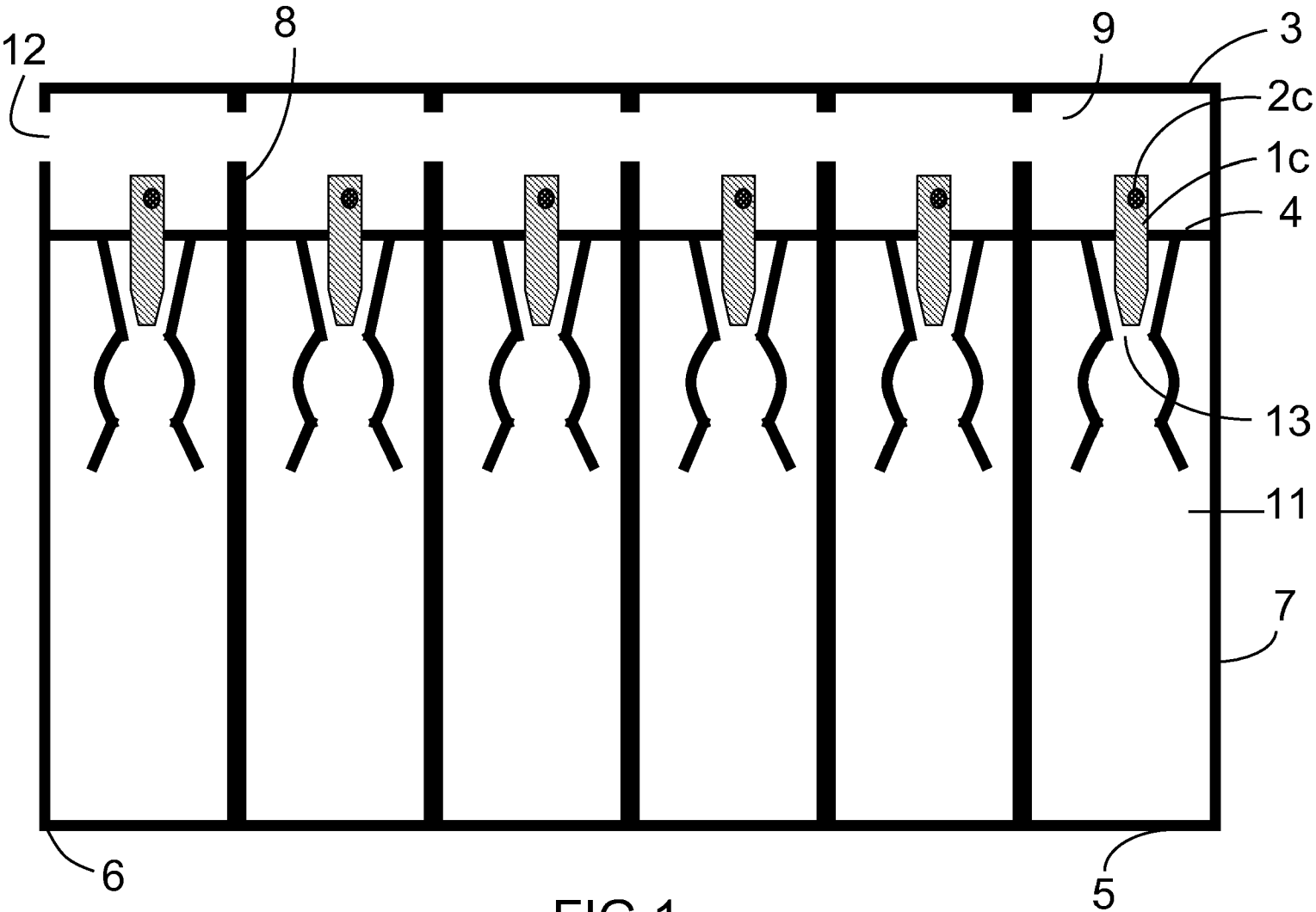
FIG. 1 is a diagrammatic plan view of inflatable pneumatic bag of the embodiment.
Figure 2A:
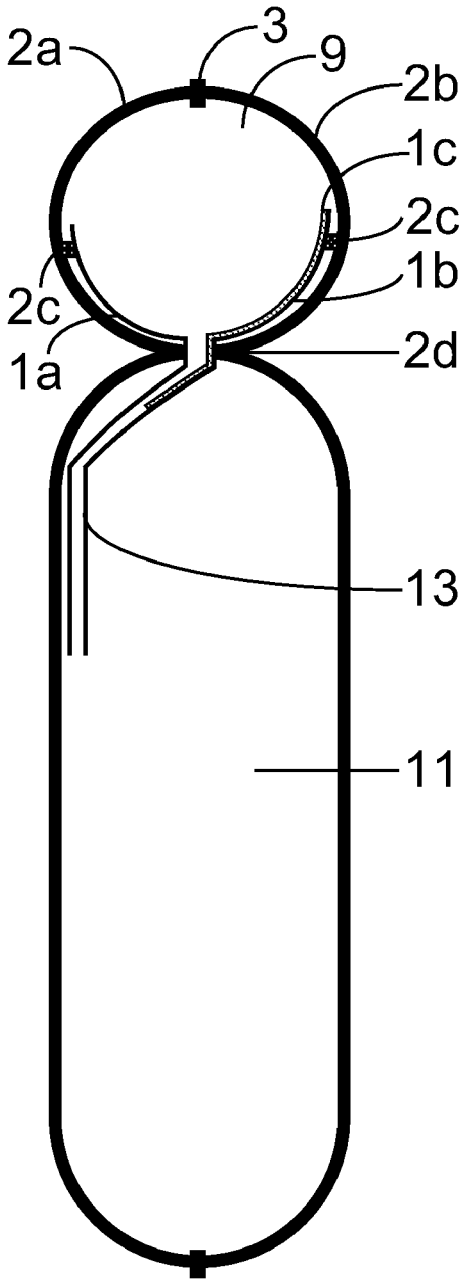
FIG. 2A is a diagrammatic cross-sectional view of inflatable pneumatic bag with two inner layers and wall-attached air passage configuration of the embodiment illustrating the pneumatic bag being filled with air.
Figure 2B:
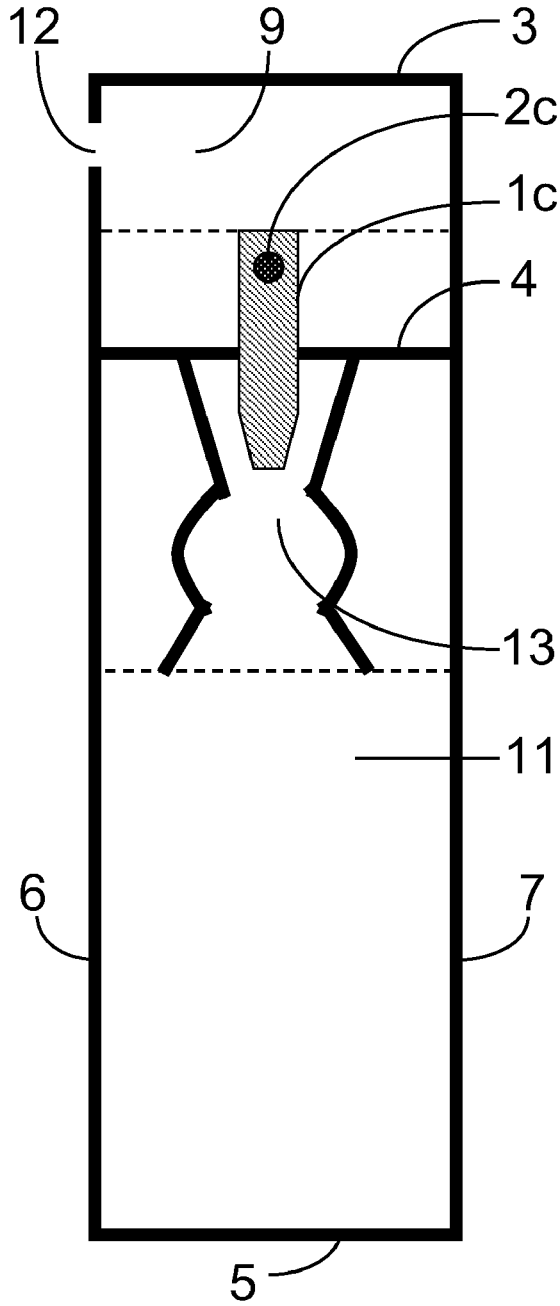
FIG. 2B is a diagrammatic cross-sectional view of inflatable pneumatic bag with two inner layers and wall-attached air passage configuration of the embodiment illustrating the pneumatic bag in flat condition.
Figure 3A:
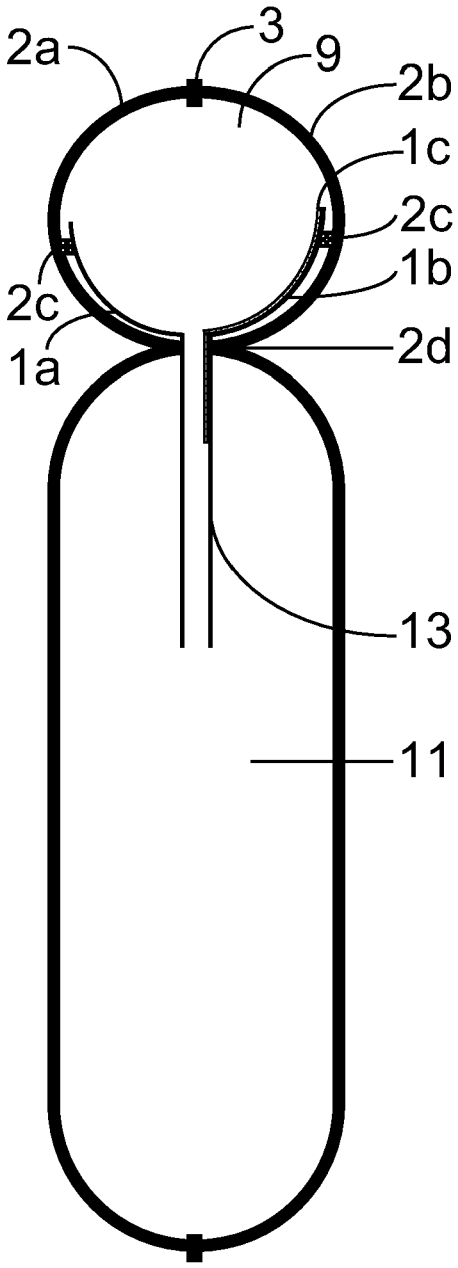
FIG. 3A is a diagrammatic cross-sectional view of inflatable pneumatic bag with two inner layers and suspension air passage configuration of the embodiment illustrating the pneumatic bag being filled with air.
Figure 3B:
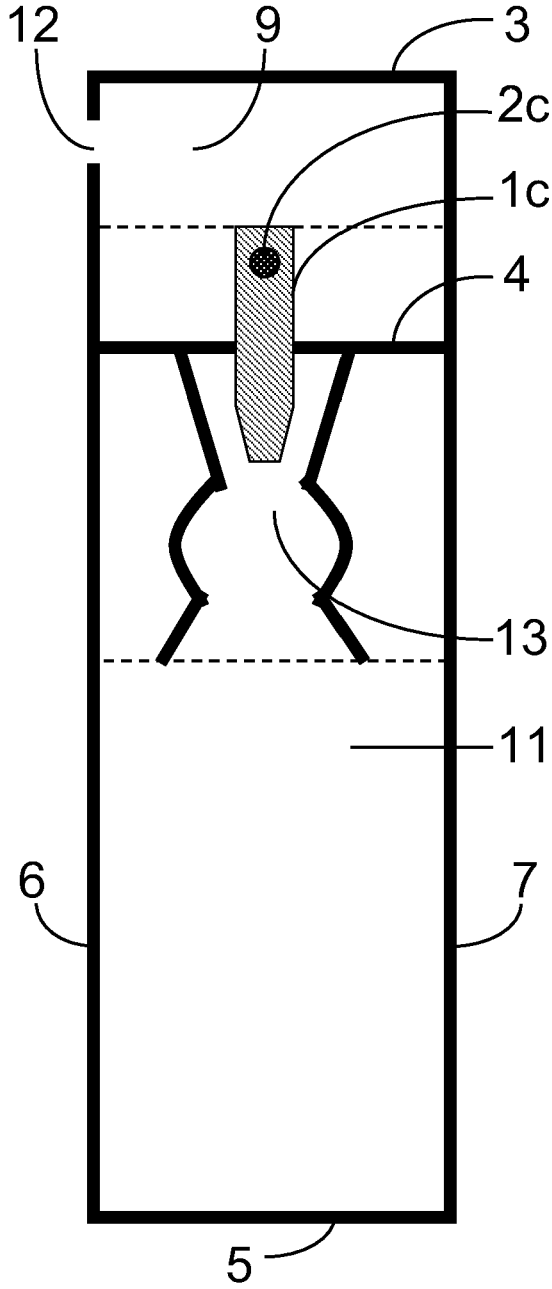
FIG. 3B is a diagrammatic cross-sectional view of inflatable pneumatic bag with two inner layers and suspension air passage of the embodiment illustrating the pneumatic bag in flat condition.

Referring to FIG. 1, 2A, 2B, an inflatable pneumatic bag with two inner layers and a wall-attached air passage configuration is described. Two outer layers 2*a*, 2*b* are provided, one overlying the other. Two inner layers 1*a*, 1*b* are between the two outer layers 2*a*, 2*b*. On one plane of the inner layers 1*a*, 1*b* not facing the outer layers 2*a*, 2*b* is coated with multiple heat-resistant materials 1*c* on the regions along the plane. The regions are arranged in a row and separate from each other. During a heat sealing operation, the heat seal lines 3, 4, 5, 6, and 7 of the outer layers 2*a*, 2*b* are sealed to form a pneumatic passage 9, multiple air ingress holes 2*d*, and multiple air tubes 11. The air ingress holes 2*d* are between the pneumatic passage 9 and the air tubes 11, which provide a connection allowing air flow between them. At least one projection portion 8 is positioned in the pneumatic passage 9, as shown in FIG. 1, to connect the two outer layers 2*a* and 2*b* to the inner layers 1*a* and 1*b*, as shown in FIGS. 2A and 3A. The two inner layers 1*a*, 1*b* are connected to the outer layers 2*a*, 2*b* with two traverse seals 2*c* which are formed by heat sealing operation. And the air ingress holes 2*d* are formed in the regions of the plane of the inner layer 1*a* or 1*b* covering with heat-resistant materials 1*c* which may prevent miscibility during the heat sealing operation. A pneumatic hole 12 in which air is applied transfers air along the pneumatic passage 9, then through the air ingress holes 2*d* covered with inner layers on the holes 2*d* which are removed by the expansion of the outer layers 2*a*, 2*b* to fill all the air tubes 11. When the air tube 11 is filled with air, the inner layers 1*a*, 1*b*, which are pressed by the air inside the air tube 11, cover and then close the air ingress hole 2*d*. Therefore the reverse air flow is overcome. Further, inside the air tube 11, there is a curve-shaped air passage 13 having one end connected to the air ingress hole 2*d*, with a diameter at one end being larger than the other end. Also, the air passage 13 contains larger pressure than the pressure inside the air tube 11. So when the air tube 11 is filled with air, the curve-shaped air passage 13 narrows as the pressure inside the air tube 11 increases which prevents the air escape. In this embodiment, the pneumatic hole 12 may be disposed at either end of the pneumatic passage 9. The air passage 13 may connect one end to the air ingress hole 2*d* and leave the other end suspending in the air tube 11 (shown in FIG. 3A, 3B). The heat-resistant materials may be a heat-resistant gel or a heat-resistant ink. The heat sealing operation is operated by heat press device.

Figure 4A:
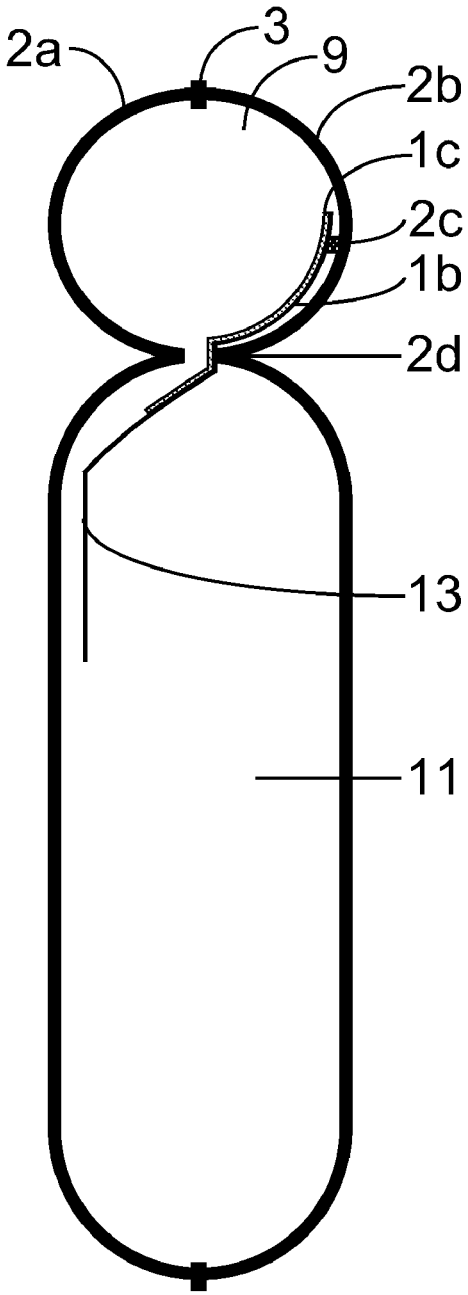
FIG. 4A is a diagrammatic cross-sectional view of inflatable pneumatic bag with single inner layer and wall-attached air passage configuration of the embodiment illustrating the pneumatic bag being filled with air.
Figure 4B:
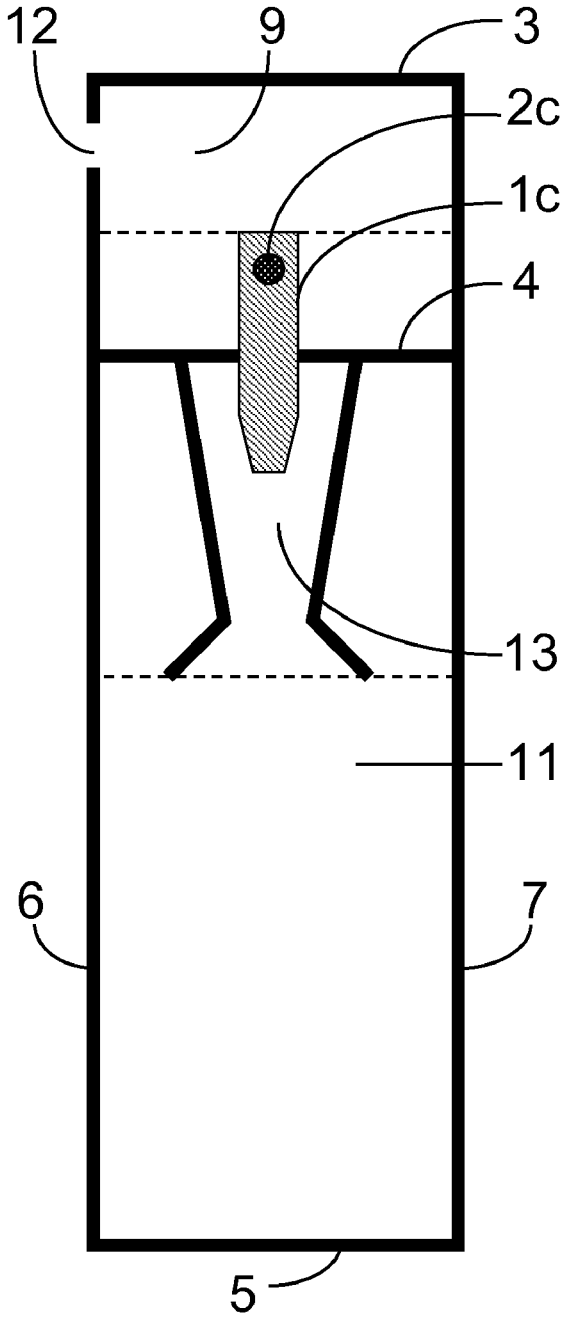
FIG. 4B is a diagrammatic cross-sectional view of inflatable pneumatic bag with single inner layer and suspension air passage configuration of the embodiment illustrating the pneumatic bag in flat condition.

Referring to FIG. 4A, 4B, an inflatable pneumatic bag with single inner layers and a wall-attached air passage configuration is described. Two outer layers 2*a*, 2*b* are provided, one overlying the other. One single inner layer 1*b* is between the two outer layers 2*a*, 2*b*. On one plane of the inner layers 1*b* not facing the outer layers 2*b* is coated with multiple heat-resistant materials 1*c* on the regions along the plane. The regions are arranged in a row and separate from each other. During a heat sealing operation, the heat seal lines 3, 4, 5, 6, and 7 of the outer layers 2*a*, 2*b* are sealed to form a pneumatic passage 9, multiple air ingress holes 2*d*, and multiple air tubes 11. The air ingress holes 2*d* are between the pneumatic passage 9 and the air tubes 11, which provide a connection allowing air flow between them. At least one projection portion 8 is positioned in the pneumatic passage 9, as shown in FIG. 1, to connect the two outer layers 2*a* and 2*b* to the inner layers 1*a* and 1*b*, as shown in FIGS. 2A and 3A. The single inner layer 1*b* is connected to the outer layer 2*b* with one traverse seal 2*c* which is formed by heat sealing operation. And the air ingress holes 2*d* are formed in the regions of the plane of the inner layer 1*b* covering with heat-resistant materials 1*c* which may prevent miscibility during the heat sealing operation.

A pneumatic hole 12 in which air is applied transfers air along the pneumatic passage 9, then through the air ingress holes 2*d* covered with inner layers 1*a*, 1*b* which are the removed by the expansion of the outer layers 2*a*, 2*b* to fill all the air tubes 11. When the air tube 11 is filled with air, the inner layer 1*b*, which is pressed by the air inside the air tube 11, covers and then closes the air ingress hole 2*d*. Therefore the reverse air flow is overcome. Further, inside the air tube 11, there is a curve-shaped air passage 13 having one end connected to the air ingress hole 2*d*, which its diameter one end is larger than the other end. Also, the air passage 13 contains larger pressure than the pressure inside the air tube 11. So when the air tube 11 is filled with air, the curve-shaped air passage 13 narrows as the pressure inside the air tube 11 increases which prevents the air escape. In this embodiment, the pneumatic hole 12 may be disposed at either end of the pneumatic passage 9. The air passage 13 may connect one end to the air ingress hole 2*d* and leave the other end suspending in the air tube 11 (shown in FIG. 3A, 3B). The heat-resistant materials may be a heat-resistant gel or a heat-resistant ink. The heat sealing operation is operated by heat press device.

Figure 5:
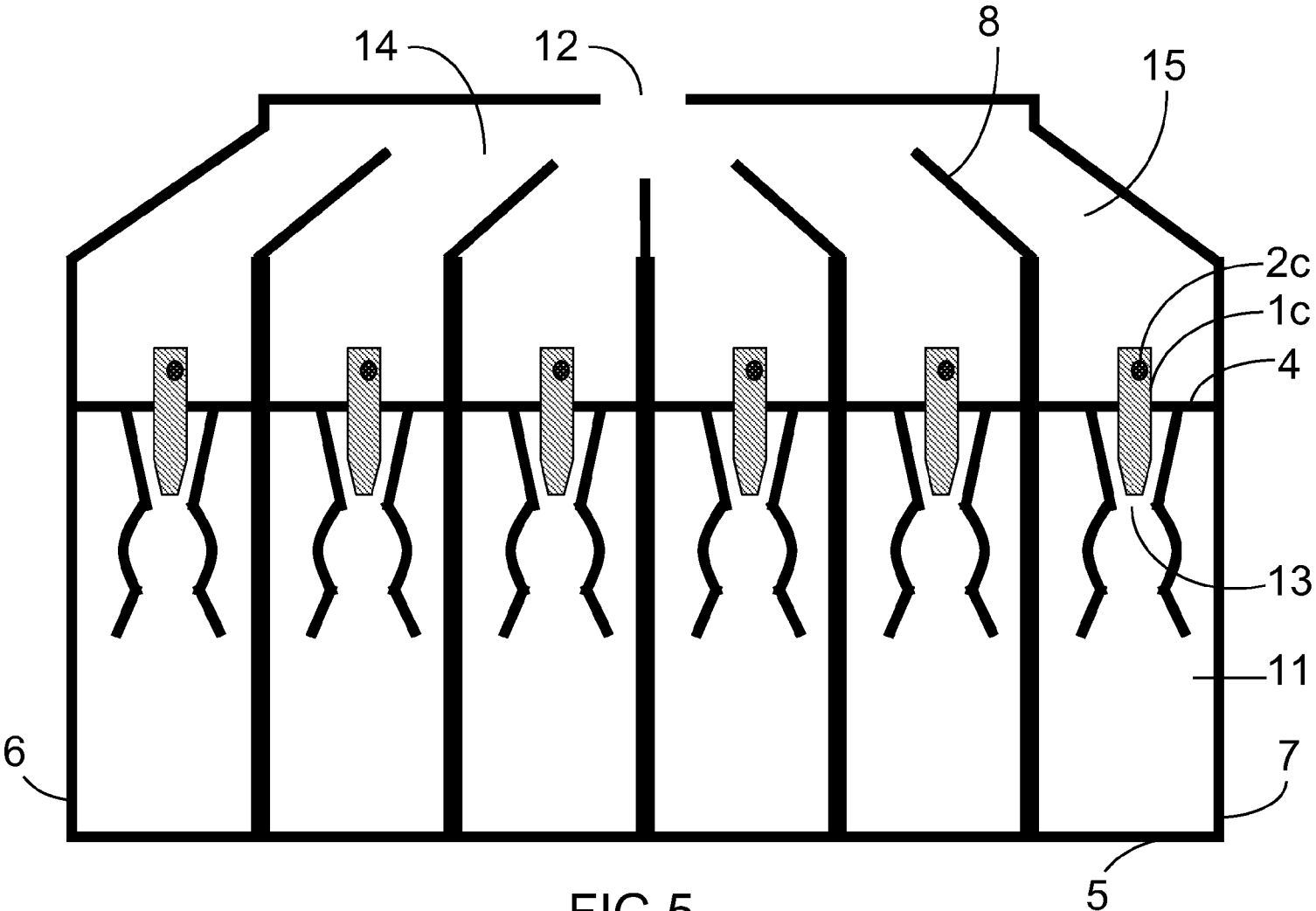
FIG. 5 is a diagrammatic cross-sectional view of inflatable pneumatic bag of another embodiment including an air chamber for air distribution.

Referring to FIG. 5, another embodiment of the invention is described. An inflatable pneumatic bag includes a pneumatic hole 12 disposed on the top of the pneumatic bag. Air, which is applied to the pneumatic hole 12, moves into an air chamber 14. The air chamber 14 then distributes air through multiple pneumatic passages 15 to fill all the air tubes 11. At least one projection portion 8 is positioned in the multiple pneumatic passages 15, as shown in FIG. 15, to connect the two outer layers 2*a* and 2*b* to the inner layers 1*a* and 1*b*, as shown in FIGS. 2A and 3A. When the air tube 11 is filled with air, two inner layers 2*a*, 2*b* cover, and then close the air ingress hole 2*d* to overcome reverse air flow. The curve-shaped air passage 13 narrows to further prevent air escape of the air tube 11. In this embodiment, the pneumatic hole 12 may be disposed on either side of the air chamber 14. The air passage 13 may be attached to either of the outer layers 2*a*, 2*b*.

Figure 6:
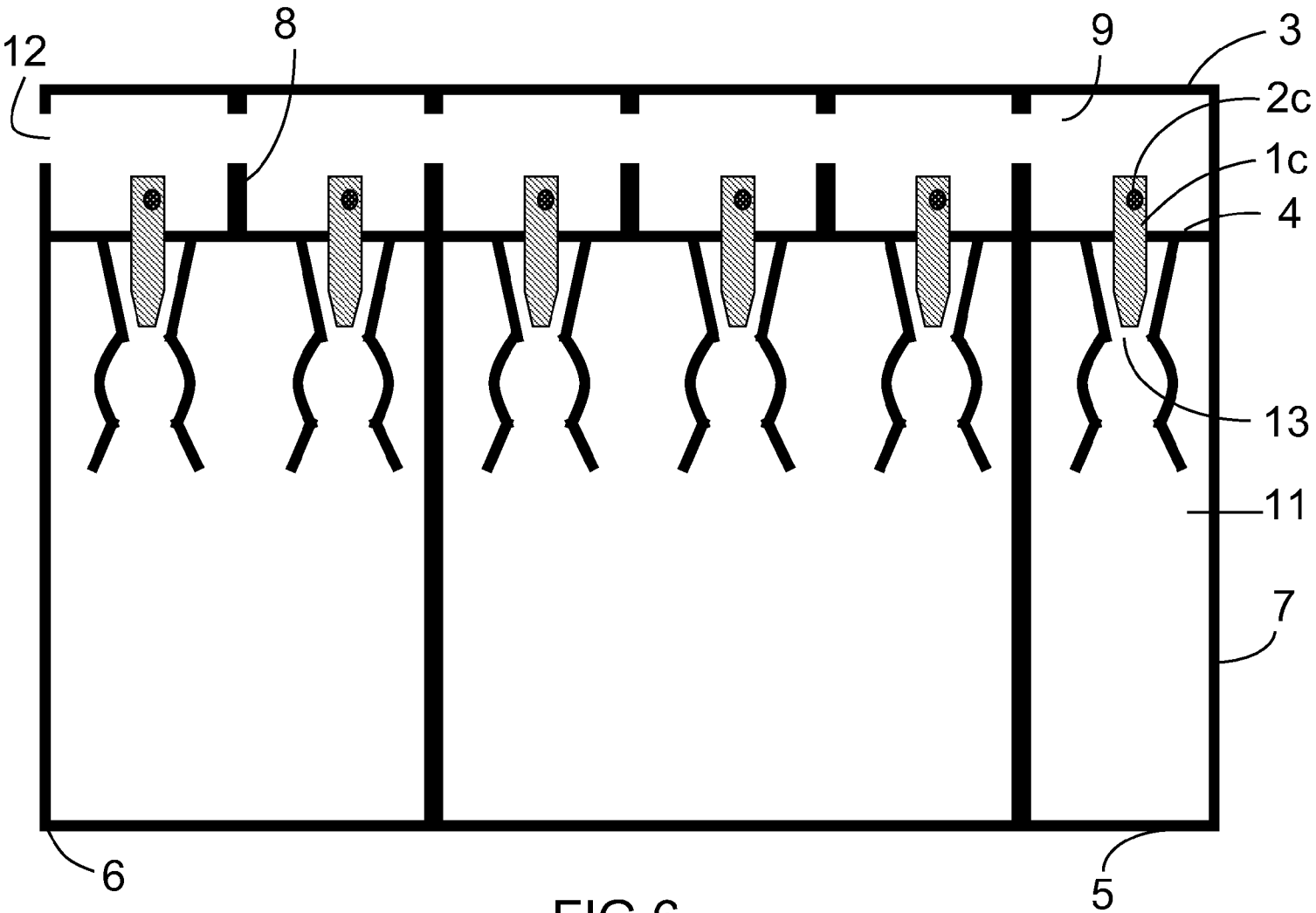
FIG. 6 is a diagrammatic cross-sectional view of inflatable pneumatic bag of another embodiment providing multiple air ingress holes and air passages for a single air tube.

Referring to FIG. 6, another embodiment of the invention is described. An inflatable pneumatic bag includes a pneumatic hole 12 for transferring air along a pneumatic passage 9. The inflatable pneumatic bag provides multiple inner layers 1*a*, 1*b*, multiple air ingress holes 2*d*, and multiple air passages 13 for a single air tube 11. Air, which is applied to the pneumatic hole 12, moves along the pneumatic passage 9 and then through the air ingress holes 2*d* and the air passages 13 to fill all the tubes 11. The pneumatic hole 12 may be disposed at either end of the pneumatic passage 9. When the air tube 11 is filled with air, the inner layers 1*a*, 1*b*, pressed by the air within the air tube 11 cover, and then close the air ingress holes 2*d*. Therefore the reverse air flow is overcome. The curve-shaped air passage 13 narrows as the pressure in the air tube 11 increases so that the air escape of the air tube 11 is prevented. Since each air tube contains more air ingress holes and air passages, the filling of all the air tubes becomes substantially efficient and effectively time-saving.

The inflatable pneumatic bag of the invention that provides the pneumatic hole at either end of the pneumatic passage may continuously fill all the air tubes. Both single and two inner layers may overcome reverse air flow. In combination with the air passage (wall-attached or suspension) further prevents air from escaping. Each of air tubes is separate. Even under certain circumstance, one or more of the air tubes leak, the remainder still functions. The air chamber and multiple pneumatic passages arrangement of the invention that distributes air to all multiple pneumatic passages at one time to fill all the air tubes saves the filling time effectively. Since each of air tubes contains more air ingress holes and air passages, filling air into the air tube becomes substantially efficient. The inflatable pneumatic bag of the invention may use to wrap variety of products in an attempt to avoid damages that inevitably occur during the shipment or other circumstances.

Although the invention has been described in terms of exemplary embodiments, it is not limited thereto. Rather, the appended claims should be considered broadly, to include other variants and embodiments of the invention, which may be made by those skilled in the art without departing from the scope and range of equivalents of the invention.

What is claimed is:

1. An inflatable pneumatic bag, comprising:

two outer layers, one overlying the other;

at least two inner layers between said outer layers;

a pneumatic passage formed by heat sealing said outer layers, which includes a pneumatic hole for applying air;

at least one projection portion, positioned in said pneumatic passage to connect said two outer layers to said inner layer;

a plurality of air tubes formed by heat sealing said outer layers for filling air therein; and a plurality of air ingress holes between said pneumatic passage and said air tubes, said air ingress holes being formed in regions separately arranged along one plane of said inner layers coated with heat-resistant materials thereon, wherein air entering said air ingress hole expands said pneumatic passage, allowing two sheets of said outer layer to be pulled apart outward to open said air ingress hole; said inner film is compressed to cover said air ingress hole to seal said air tube after said air enters said air tube.

2. The inflatable pneumatic bag as claimed in claim 1, wherein one of said inner layers connects to one of said outer layers with one traverse seal.

3. The inflatable pneumatic bag as claimed in claim 1, wherein said inner layers connect to said outer layers with two traverse seals.

4. The inflatable pneumatic bag as claimed in claim 1, wherein one of said air tubes further comprises an air passage having one end connected to said air ingress hole of a diameter larger than a diameter at the other end of the air passage.

5. The inflatable pneumatic bag as claimed in claim 1, further comprising at least one transverse seal, positioned in said pneumatic passage and between one sheet of said outer layer and one sheet of said inner layer to connect one sheet of said outer layer to one sheet of said inner layer, and two sheets of said inner film not stuck to each other being driven to pull apart outward to open said air ingress hole automatically through said transverse seals when two sheets of said outer film are pulled apart outward.

6. An inflatable pneumatic bag, comprising:

two outer layers, one overlying the other;

at least two inner layers between said outer layers;

at least one projection portion, positioned in said pneumatic passage to connect said two outer layers to said inner layer;

an air chamber formed by heat sealing said outer layers, which includes a pneumatic hole for applying air;

a plurality of pneumatic passages formed by heat sealing said outer layers, said pneumatic passages each connecting at one end to said air chamber;

a plurality of air tubes formed by heat sealing said outer layers for filling air therein; and a plurality of air ingress holes between said pneumatic passages and said air tubes, said air ingress holes being formed in regions separately arranged along one plane of said inner layers coated with heat-resistant materials thereon, wherein air entering said air ingress hole expands said pneumatic passage, allowing two sheets of said outer layer to be pulled apart outward to open said air ingress hole; said inner film is compressed to cover said air ingress hole to seal said air tube after said air enters said air tube.

7. The inflatable pneumatic bag as claimed in claim 6, wherein one of said inner layers connects to one of said outer layers with one traverse seal.

8. The inflatable pneumatic bag as claimed in claim 6, wherein said inner layers connect to said outer layers with two traverse seals.

9. The inflatable pneumatic bag as claimed in claim 6, wherein one of said air tubes further comprises an air passage having one end connected to said air ingress hole of a diameter larger than a diameter at the other end of the air passage.

10. The inflatable pneumatic bag as claimed in claim 6, further comprising at least one transverse seal, positioned in said pneumatic passage and between one sheet of said outer layer and one sheet of said inner layer to connect one sheet of said outer layer to one sheet of said inner layer, and two sheets of said inner film not stuck to each other being driven to pull apart outward to open said air ingress hole automatically through said transverse seals when two sheets of said outer film are pulled apart outward.

11. A method for manufacturing an inflatable pneumatic bag, comprising the steps of:

providing at least two inner layers;

coating a plurality of heat-resistant materials on regions along one plane of said inner layer, said regions arranged separately;

overlying one outer layer the other with said inner layers between said outer layers;

heat sealing heat seal lines of said outer layers to form a pneumatic passage and a plurality of air tubes;

forming a plurality of air ingress holes from said regions to connect said pneumatic passage and said airtubes, and using at least one projection portion positioned in said pneumatic passage to connect one sheet of said outer film to one sheet of said inner film;

applying air to expand said pneumatic passage, allowing two sheets of said outer film to be pulled apart outward to open said air ingress hole;

filling said air into said air tube continuously via said air ingress hole; and covering and then closing said air ingress hole with said inner layers pressed by the air inside said air tube when said air tube is filled with air.

12. The method as claimed in claim 11, wherein said heat-resistant material is coated on said inner layers by printing.

13. The method as claimed in claim 11, wherein one of said inner layers connects to one of said outer layers with one traverse seal.

14. The method as claimed in claim 11, wherein said inner layers connect to said outer layers with two traverse seals.

15. The method as claimed in claim 11, further comprising using at least one transverse seal positioned in said pneumatic passage and between one sheet of said outer film and one sheet of said inner film to connect one sheet of said outer film to one sheet of said inner film; and driving two sheets of said inner film not stuck to each other to pull apart outward to open said air ingress hole automatically through said transverse seals when two sheets of said outer film are pulled apart outward.

16. A method for manufacturing an inflatable pneumatic bag, comprising:

providing at least two inner layers;

coating a plurality of heat-resistant materials on regions along one plane of said inner layer, said regions arranged separately;

overlying one outer layer the other with said inner layers between said outer layers;

heat sealing heat seal lines of said outer layers and said inner layers to form an air chamber, a plurality of pneumatic passages, and a plurality of air tubes, each of said pneumatic passages having one end connecting to said air chamber;

forming a plurality of air ingress holes from said regions to connect said pneumatic passages and said air tubes, and using at least one projection portion positioned in said pneumatic passage to connect one sheet of said outer film to one sheet of said inner film;

applying air to expand said pneumatic passage, allowing two sheets of said outer film to be pulled apart outward to open said air ingress hole;

filling said air into said air tube continuously via said air ingress hole; and covering and then closing said air ingress hole with said inner layers pressed by the air inside said air tube when said air tube is filled with air.

17. The method as claimed in claim 16, wherein said heat-resistant material is coated on said inner layers by printing.

18. The method as claimed in claim 16, wherein one of said inner layers connects to one of said outer layers with one traverse seal.

19. The method as claimed in claim 16, wherein said inner layers connect to said outer layers with two traverse seals.

20. The method as claimed in claim 16, further comprising using at least one transverse seal positioned in said pneumatic passage and between one sheet of said outer film and one sheet of said inner film to connect one sheet of said outer film to one sheet of said inner film; and driving two sheets of said inner film not stuck to each other to pull apart outward to open said air ingress hole automatically through said transverse seals when two sheets of said outer film are pulled apart outward.

* * * * *